US010604933B1

(12) United States Patent
Gilner et al.

(10) Patent No.: US 10,604,933 B1
(45) Date of Patent: Mar. 31, 2020

(54) SLAB BOLSTER WITH IMPROVED CONNECTOR SYSTEM

(71) Applicant: Inland Concrete Products, Inc., Fontana, CA (US)

(72) Inventors: John H. Gilner, Santa Barbara, CA (US); G. Douglas Hartzheim, Bozeman, MT (US); Steven R. Wilbur, Yucaipa, CA (US)

(73) Assignee: Inland Concrete Products, Inc., Fontana, CA (US)

( * ) Notice: Subject to any disclaimer, the term of this patent is extended or adjusted under 35 U.S.C. 154(b) by 0 days.

(21) Appl. No.: 16/204,861

(22) Filed: Nov. 29, 2018

(51) Int. Cl.
*E04C 5/16* (2006.01)
*E04C 5/20* (2006.01)
*E01C 11/18* (2006.01)

(52) U.S. Cl.
CPC ..... *E04C 5/163* (2013.01); *E04C 5/20* (2013.01); *E01C 11/18* (2013.01)

(58) Field of Classification Search
CPC ..... E04C 5/163; E04C 5/20; E01C 11/18
See application file for complete search history.

(56) References Cited

U.S. PATENT DOCUMENTS 3,529,392 A 9/1970 Admas
3,839,838 A 10/1974 Vigh
3,844,000 A 10/1974 Hedu
4,942,714 A 7/1990 Langley, Jr. et al.
5,664,390 A 9/1997 Sorkin
D393,997 S 5/1998 Hartzheim
6,722,097 B2 4/2004 Haslem et al.
6,735,918 B2 5/2004 Haslem et al.
6,772,571 B1 8/2004 Sorkin
6,948,291 B2 * 9/2005 Haslem ..... E04C 5/20 52/371
D571,189 S 6/2008 Verelli et al.
7,775,010 B2 8/2010 Lee et al.
8,616,108 B2 * 12/2013 Lukas ..... B23D 49/105 30/289
10,106,985 B1 * 10/2018 Waldner ..... E04C 5/20
10,329,768 B2 * 6/2019 Verelli ..... E01C 11/18
2008/0184656 A1 * 8/2008 Lee ..... E04C 5/20 52/688
2014/0318062 A1 * 10/2014 Richardson ..... E04B 2/8635 52/309.1
2018/0298614 A1 * 10/2018 Verelli ..... E01C 11/18

* cited by examiner

*Primary Examiner* — Rodney Mintz
(74) *Attorney, Agent, or Firm* — Klein, O'Neill & Singh, LLP

(57) ABSTRACT

A slab bolster element includes a frame member having a male connector at a first end and a female connector at an opposite second end. The male connector includes a substantially solid insertion body with a surface having a transverse locking groove. The female connector includes a receptacle body configured to receive the insertion body of a complementary male connector, and a resiliently flexible locking tab positioned and configured to resiliently deflect to allow the insertion of the insertion body of another slab bolster element into the receptacle body, and to resiliently engage with the transverse locking groove of the insertion body when the insertion body is received within the receptacle body.

11 Claims, 7 Drawing Sheets

SLAB BOLSTER WITH IMPROVED CONNECTOR SYSTEM

CROSS-REFERENCE TO RELATED APPLICATIONS

Not applicable.

FEDERAL SPONSORED RESEARCH OR DEVELOPMENT

Not applicable

BACKGROUND

The present disclosure pertains to slab bolsters for use in the construction of reinforced concrete structures. More particularly, it relates to a slab bolster with improved coupling capabilities. Still more specifically, it relates to a slab bolster coupling or connection mechanism for joining a plurality of slab bolster elements together to form a continuous bolster of a desired length.

Concrete is used in a variety of construction methods. In many cases, a concrete form or mold is created, and then wet concrete is poured into the mold. In reinforced concrete construction, reinforcing bars, or rebar, is positioned in a slab form prior to pouring wet concrete. The rebar may improve the strength of the finished concrete structure or slab, particularly by increasing tensile strength.

Various means and methods can be used to position the rebar where the concrete will be poured. In many applications, relatively lightweight frame members, known as slab bolsters, are used as supports to position and elevate a plurality of reinforcing bars in a slab form or mold before the concrete is poured. The slab bolsters are typically positioned at spaced intervals on a deck or grade within a slab form to support rebar prior to pouring wet concrete. After positioning the bolsters within the slab form, rebar may be placed across the support surfaces of parallel slab bolsters. If a slab form is wider than a single slab bolster, it may be necessary to connect two or more slab bolsters together linearly to form a continuous bolster across the entire width of the slab form. Accordingly, various connecting or coupling mechanisms have been devised to perform this function, such as disclosed, for example, in U.S. Pat. No. 7,775,010.

It has been a goal in the field of slab bolsters to provide coupling or connecting elements that provide more secure connection of bolsters to each other, while also providing greater simplicity and ease in connecting the bolsters. In particular, it is desired to provide a coupling mechanism that is simple to assemble, yet that is resistant to unintentional decoupling when in use.

SUMMARY

Broadly, slab bolsters in accordance with an aspect of this disclosure include an elongate frame member that provides support for a plurality of reinforcing bars. To allow two or more bolsters to be connected together linearly, the frame member has a first end and an opposed second end, wherein the first end is configured to mate with the second end of a frame member of a second bolster. Specifically, a male connector is provided at the first end of each bolster frame member, wherein the male connector comprises an insertion body including at least a first locking groove. A complementary female connector is provided at the second end of each bolster frame member, wherein the female connector comprises a receptacle body configured for receiving the insertion body of a male connector of another slab bolster, wherein the receptacle body includes a first resiliently deflectable locking tab that engages with, and locks into, the locking groove of the insertion body as it is inserted into the receptacle body. In this way, two or more slab bolsters can be connected together linearly by connecting a male connector at a first end of a first slab bolster with a mating female connector at a second end of a second slab bolster.

In accordance with an aspect of the disclosure, a slab bolster or bolster element comprises a frame member having a first end and an opposed second end; a male connector at the first end, the male connector comprising a solid insertion body including surface having a first transverse locking groove; and a complementary female connector at the second end, the female connector having a receptacle body configured for receiving the insertion body of a male connector of another slab bolster element and including a resiliently flexible locking tab; wherein the resiliently flexible locking tab of the female connector is resiliently engageable with the locking groove in the insertion body of the male connector of the other slab bolster element, and wherein the locking tab and the locking groove are configured to inhibit the removal of the insertion body from the receptacle body of the female connector. In another aspect of this disclosure, the solid insertion body includes first and second transverse locking grooves, and the female connector includes first and second locking tabs that are engageable with the second and first locking grooves, respectively.

As will be better appreciated from the detailed description below, the complementary male and female connector elements in accordance with the present disclosure provide for a relatively low insertion force of the male into the female connector. Moreover, in using an essentially solid, unitary male connector with no movable or deformable components, and in providing a positive locking engagement between the male and female connectors that resists the withdrawal of the male connector from the female connector, connector assemblies in accordance with this disclosure provide a robust coupling between adjacent bolster elements that resists inadvertent decoupling under tensile and flexural loads. In this manner, the probability of inadvertent decoupling is minimized.

DETAILED DESCRIPTION

The detailed description set forth below in connection with the appended drawings is intended as a description of the present embodiments of slab bolster elements provided in accordance with aspects of the present components, assemblies, and method and is not intended to represent the only forms in which the present components, assemblies, and method may be constructed or utilized. The description sets forth the features and the steps for constructing and using the embodiments of the present components, assemblies, and method in connection with the illustrated embodiments. It is to be understood, however, that the same or equivalent functions and structures may be accomplished by different embodiments that are also intended to be encompassed within the spirit and scope of the present disclosure. As denoted elsewhere herein, like element numbers are intended to indicate like or similar elements or features.

The present disclosure relates to a slab bolster element that comprises an elongate frame member with first and second ends, terminating, respectively, in a male connector and a female connector. Two or more slab bolster elements can be connected to each other linearly to form a continuous bolster assembly of the desired length by mating the male connector of one slab bolster element with the female connector of another slab bolster element. The male connector includes a substantially solid insertion body with at least a first locking groove, and, preferably, a second locking groove. The complementary female connector includes a receptacle body configured to receive the insertion body of the male connector. The receptacle body has a central opening and at least a first locking tab and, preferably, a second locking tab, each of which is resiliently flexible or deflectable. The first and second locking tabs positionally correspond to the second and first locking grooves, respectively, whereby, as the insertion body of the male connector is inserted into the central opening of the receptacle body of the female connector, the insertion body resiliently deflects the first locking tab and the second locking tab, which, owing to their resiliency, will tend to return to their original (undeflected) positions. The first and second locking tabs of the receptacle body of the female connector will thereby catch the second and first locking grooves, respectively, of the insertion body of the male connector as the insertion body is inserted into the central opening of the receptacle body.

Figure 1:
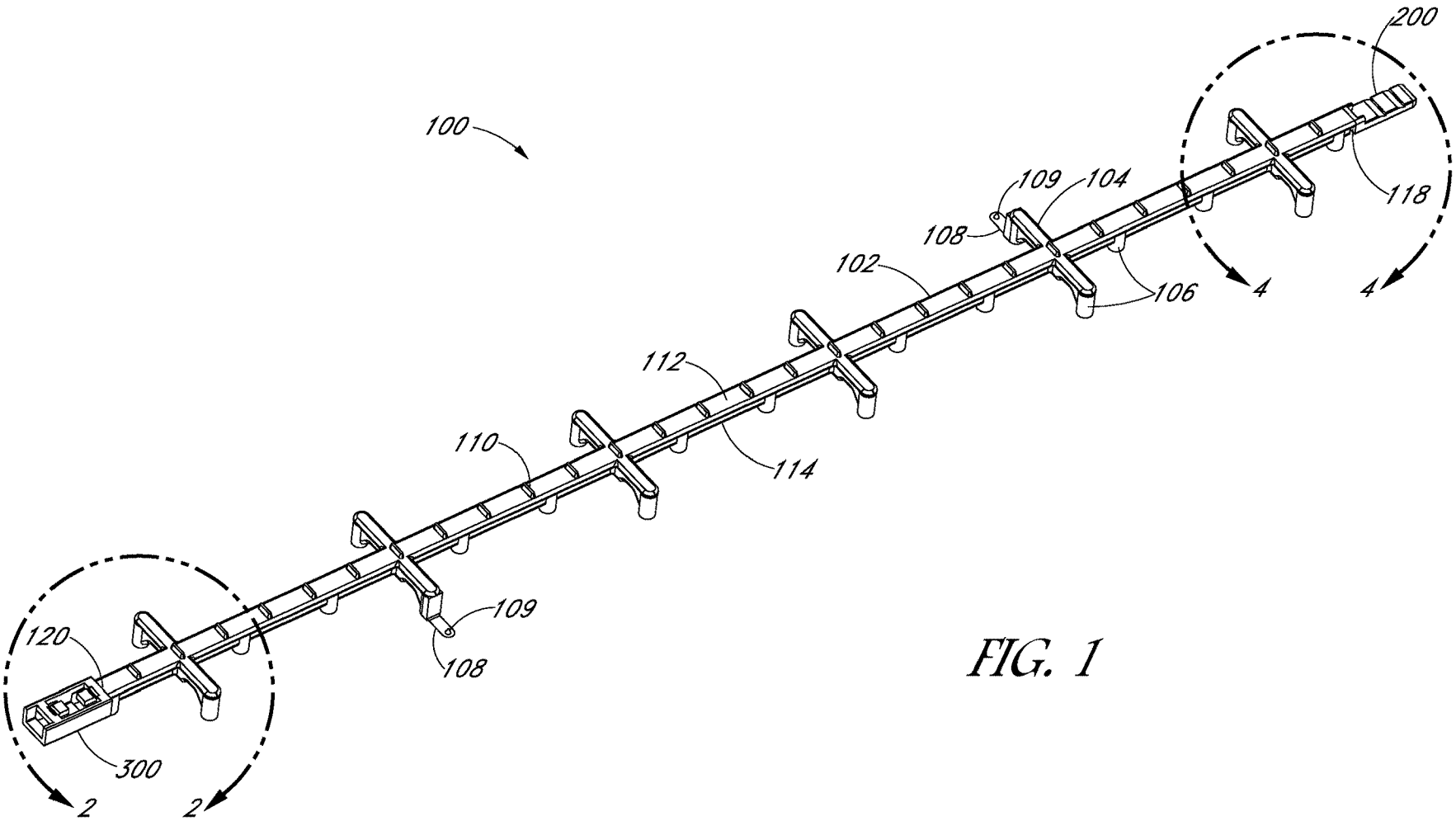
FIG. 1 shows a perspective view of a slab bolster element having male and female connectors at opposite ends of a bolster frame member in accordance with aspects of this disclosure.

FIG. 1 illustrates a perspective view of a slab bolster element 100. The slab bolster element 100 includes a frame member 102 that extends longitudinally from a first end 118 to a second end 120, terminating, respectively, in a male connector 200 and a female connector 300, which are described in detail below. The frame member may be of any convenient length; in many applications, the length of the frame member will be about 5 to 10 feet (about 1.5 m to 3 m), although shorter and longer lengths may be used.

Figure 3:
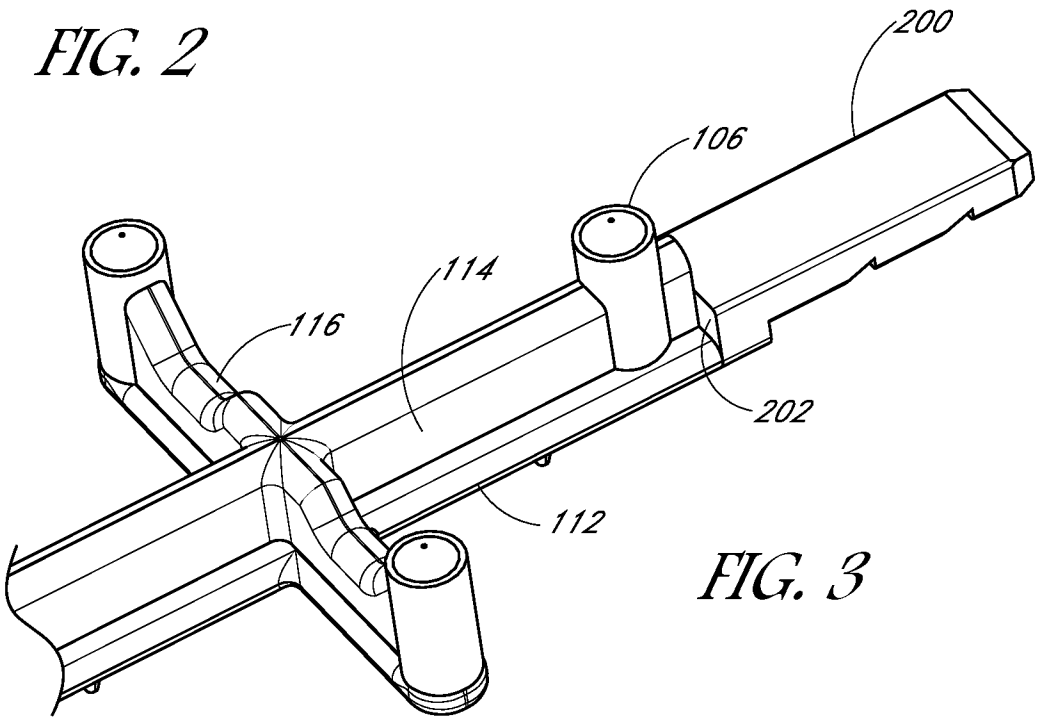
FIG. 3 shows a perspective view of the first end of the bolster element and the male connector from a bottom side.
Figure 4:
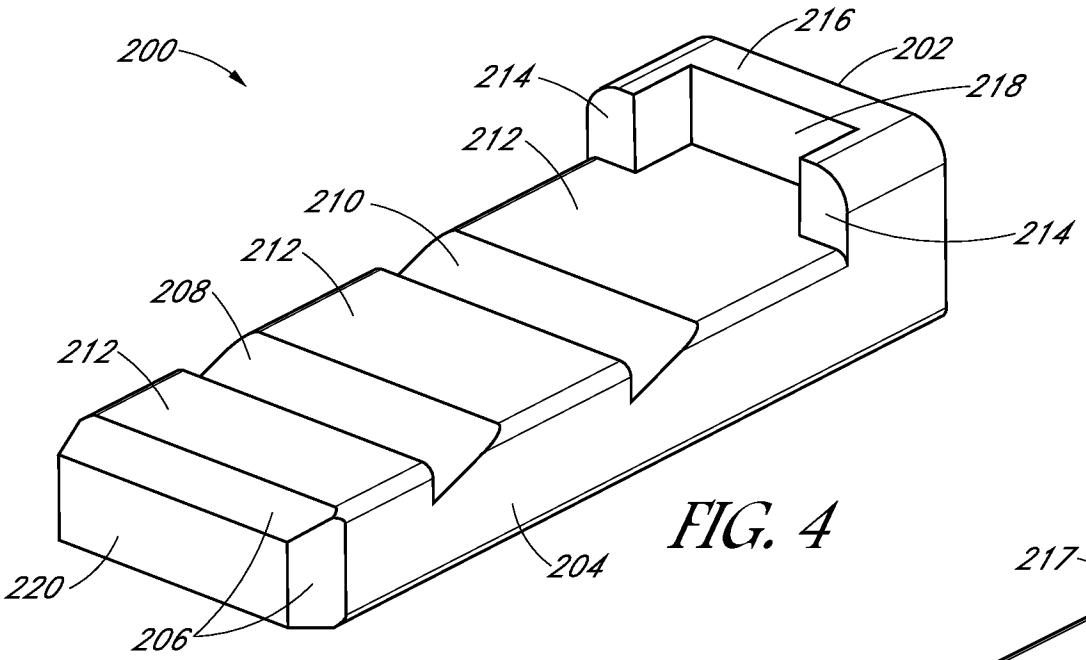
FIG. 4 shows a perspective view of the male connector from a top side.

To allow for using less material, the frame member 102 may have a T-shape cross sectional shape through a top rail 112 and a bottom rail 114. As shown in FIG. 3, the bottom rail 114 may have a smaller width than the top rail 112, such as, for example, approximately 30% to 80% of the width of the top rail 112. The bottom rail 114 may have a top to bottom thickness greater than a thickness of the top rail 112. For example, the top rail 112 may have a thickness approximately 10% to 70% of the thickness of the bottom rail 114.

The frame member 102 may have at least one transverse stabilizing arm 104 extending laterally from the frame member 102. The stabilizing arm 104 may extend outward on either side of the frame member 102. The ends of each stabilizing arm 104 may have standoffs 106 extending below the bottom rail 114, so that the bolster frame member 102 may be positioned in a slab form and rest on the standoffs 106. Typically, a plurality of stabilizing arms 104 will be disposed along the length of the frame member 102 at fixed intervals. The stabilizing arms 104 and their respective standoffs 106 can prevent rocking of the slab bolster 100, thereby providing stability to the slab bolster when it is positioned in the slab form. As shown in FIG. 3, a plurality of standoffs 106 may be provided on both the frame member 102 and the stabilizing arms 104.

In some embodiments, a mounting tab 108 may extend laterally from the bottom of the standoff 106 of one or more of the stabilizing arms 104. The mounting tab 108 may advantageously have an aperture 109 for a fastener or anchor (not shown) to fix the slab bolster 100 in a slab form. A mounting tab need not be provided on every stabilizing arm, but it may be advantageous to provide at least two mounting tabs 108, preferably on opposite sides of the frame member 102, as shown in FIG. 1.

In some embodiments, the frame member 102 may have an array of rebar positioners 110 at spaced intervals on the top rail 112. As shown, the rebar positioners 110 are advantageously configured as transverse projections extending upwardly from the top rail 112 that separate the reinforcing bars (not shown) when the slab bolster 100 is positioned in a slab form. In this way, the slab bolster 100 may support and elevate the rebar inside the slab form, fixing the position of the rebar and preventing the rebar from rolling and shifting. Alternatively, the rebar positioners 110 may be configured as transverse grooves across the width of the top rail 112. Typically, at least two parallel rows of slab bolsters are installed in a slab form, such that the rebar can be positioned across the two parallel rows of slab bolsters, with their spacing being maintained by the positioners 110.

Figure 2:
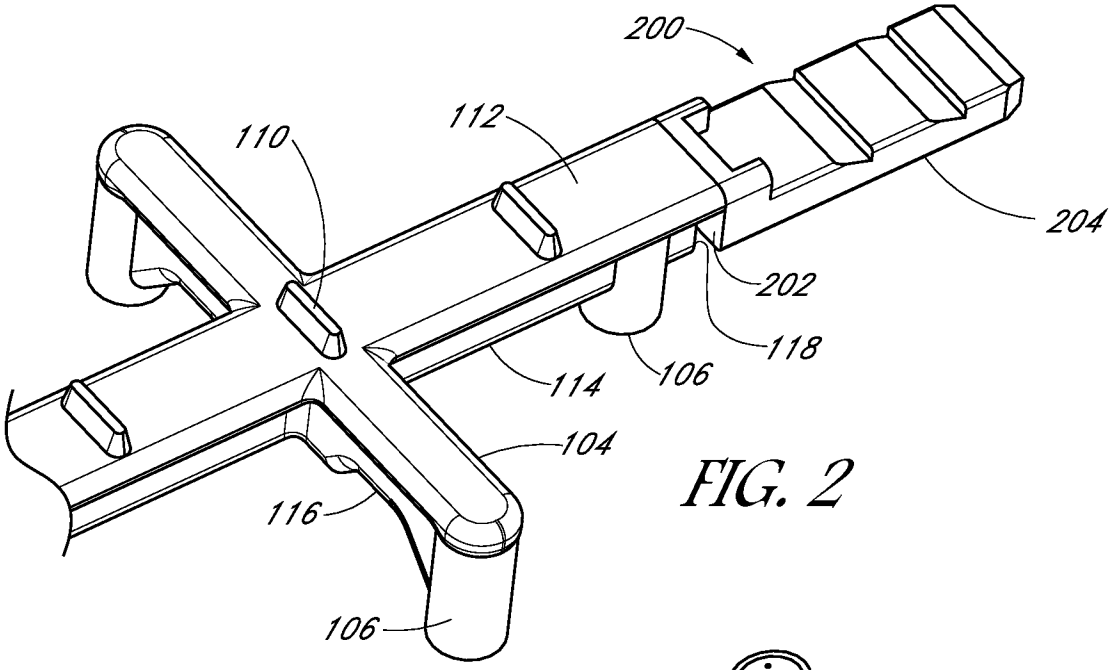
FIG. 2 shows a perspective view of the first end of the bolster element and the male connector from a top side.

As shown in FIG. 2, the rebar positioners 110 may have a "stadium" shape when viewed from the top. The "stadium" shape may be understood as a rectangle with a semicircle at each end. As noted above, the rebar positioners 110 can be oriented transverse, or across, the frame member 102, so that the rectangle is across the frame member 102, and the semicircles are on either side of the width of the frame member 102. In some embodiments, the rebar positioners 110 may taper inwardly as it projects away from the top rail 112, so as to be substantially trapezoidal in cross-sectional shape. The rebar positioners 110 preferably extend across at least 30% of the width of the top rail 112, and more preferably across closer to 100%, such as, for example, 50% to 90%. In some embodiments, one or more of the rebar positioners 110 may be positioned to be aligned, or collinear, with a stabilizing arm 104. In some embodiments, alternative geometric shapes for the rebar positioners 110 may be utilized. For example, the alternative geometric shapes may include a pyramid, a truncated pyramid, a cone, a truncated cone, a rectangle, a parallelogram, a dome, or another shape that would restrict the rebar from shifting position.

Embodiments of the slab bolster element 100 may be made from plastic, metal, or a composite. In some embodiments, combinations of different materials may be used. For example, the frame member 102 may be made of metal while the male connector 200 and the female 300 connector may be made of plastic. Alternatively, the male connector 200 and the female connector 300 may be made of different materials from one another. Methods of manufacturing may include forging, injection molding, machining, casting, metal injection molding, or three-dimensional printing (3-D printing).

As shown in FIGS. 2 and 3, the stabilizing arm 104 may have a rib recess 116 on a bottom side. The rib recess 116 may be between the frame member 102 and a standoff 106 of the stabilizing arm 104. The rib recess 116 may be a portion of the stabilizing arm 104 having a smaller thickness than portions of the stabilizing arm 104 nearer to the frame member 102 and the standoff 106. The rib recess 116 may allow for using less material while preserving stability or strength of the stabilizing arm. Additionally, the rib recess 116 may allow for concrete to fill the space below the rib recess 116 in the slab mold.

As further shown in FIGS. 2 and 3, the male connector 200 has an inner end 202 that is attached to the first end 118 of the frame member 102. An insertion body 204 of the male connector 200 extends outwardly from the inner end 202. While the male connector 200 is preferably integral with the frame member 102, in some embodiments, the frame member 102 and the male connector 200 may be separately formed and then coupled together by means of plastic welding, welding, or adhesive. As shown in FIG. 3, the thickness of the male connector 200 may be less than the combined thickness of the top rail 112 and the bottom rail 114. The male connector 200 may have a thickness greater than the top rail 112. The male connector 200 may have a width approximately the same as the width of the top rail 112.

FIGS. 4-10 illustrate the male connector 200 in detail. The insertion body 204 of the male connector 200, which extends outwardly from the inner end 202, is a solid element, meaning that it has no movable or deformable parts or components, thereby providing good structural strength, integrity, and durability. For example, in some embodiments, the insertion body 204 may have hollowing recesses for weight-saving or limiting material usage while still retaining the structural qualities of a solid element, and thus would be encompassed by the term "solid," for the purposes of this disclosure. The insertion body may be generally rectangular in cross-sectional shape (although other shapes be advantageous in certain applications), and it is dimensioned for insertion into a complementary female connector 300. The female connector 300, as described below with reference to FIGS. 13-19, includes a receptacle body 318 with a central opening 304 dimensioned and configured to receive the insertion body 204 of the male connector 200, whereby the male connector and the female connector can form a mating connection or coupling, as described below.

Opposite the inner end 202, the insertion body 204 has an outer or distal end 220. The outer end 220 may have one or more chamfered edges 206, or a tapering configuration that facilitate the insertion of the insertion body 204 into a central opening 304 of the female connector 300. The chamfered edges 206 may facilitate alignment and fitment of the insertion body 204 into the central opening 304 of the female connector 300.

Figure 8:
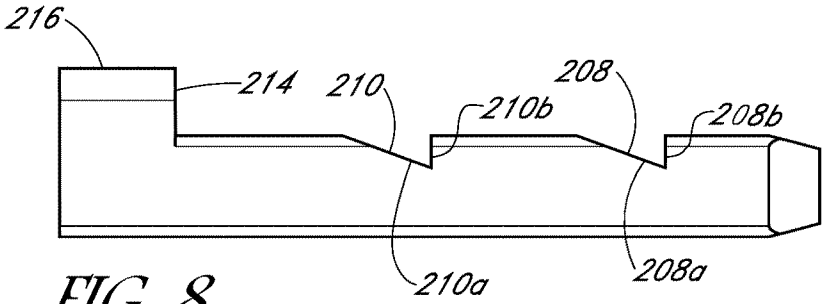
FIG. 8 shows a side plan view of the male connector.
Figure 10:
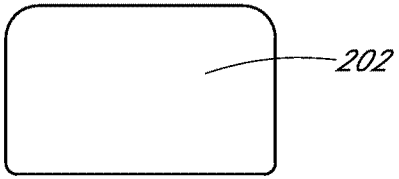
FIG. 10 shows a back plan view of the male connector.
Figure 9:
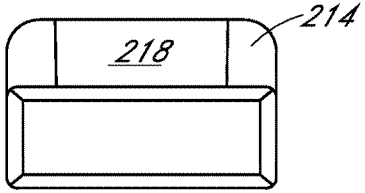
FIG. 9 shows a front plan view of the male connector.

The insertion body 204 of the male connector 200 has a top surface 212 with at least a first transverse locking groove 208 and, preferably, a parallel second transverse locking groove 210. Although the embodiment shown in FIG. 4 has two locking grooves 208, 210, there may only be one locking groove or three or more locking grooves as needed for security. The first locking groove 208 and the second locking groove 210 may each be defined by a sloped surface 208*a*, 210*a*, and a substantially vertical catch surface 208*b*, 210*b*, as shown in FIG. 8. The sloped surfaces 208*a*, 210*a*, and the catch surfaces 208*b*, 210*b* may meet at an acute angle to define the first locking groove 208 and the second locking groove 210. Although the exemplary embodiment shown in FIGS. 1-10 has the first locking groove 208 and the second locking groove 210 extending perpendicularly relative to the length of the frame member (i.e., the direction of insertion of the male connector 200), the first locking grooves 208 and the second locking groove 210 can each be at an oblique angle relative to the length of the frame member or the direction of insertion. For the purposes of this disclosure, such angled grooves will be considered "transverse". Accordingly, the detents 384, 394 of the female connector 300 as discussed below with respect with FIG. 17 can be similarly angled to correspond to the locking grooves 208, 210.

A transverse inner end wall 216 may be provided that extends upwardly from the inner end 202 of the insertion body 204. A pair of longitudinal side walls extend from opposite sides of the transverse inner end wall and function as insertion stops 214. The insertion stops 214 can also be seen in FIG. 9, which illustrates a front plan view of the male connector 200, as viewed from the outer end 220 towards the transverse inner end wall 216. The insertion stops 214 can act as physical stops for the relative movement of the male connector 200 and the female connector 300. Additionally, the transverse inner end wall 216, together with the insertion stops 214, can define a pocket 218. When the male connector 200 and the female connector 300 are connected together, the pocket 218 may be exposed.

Figure 5:
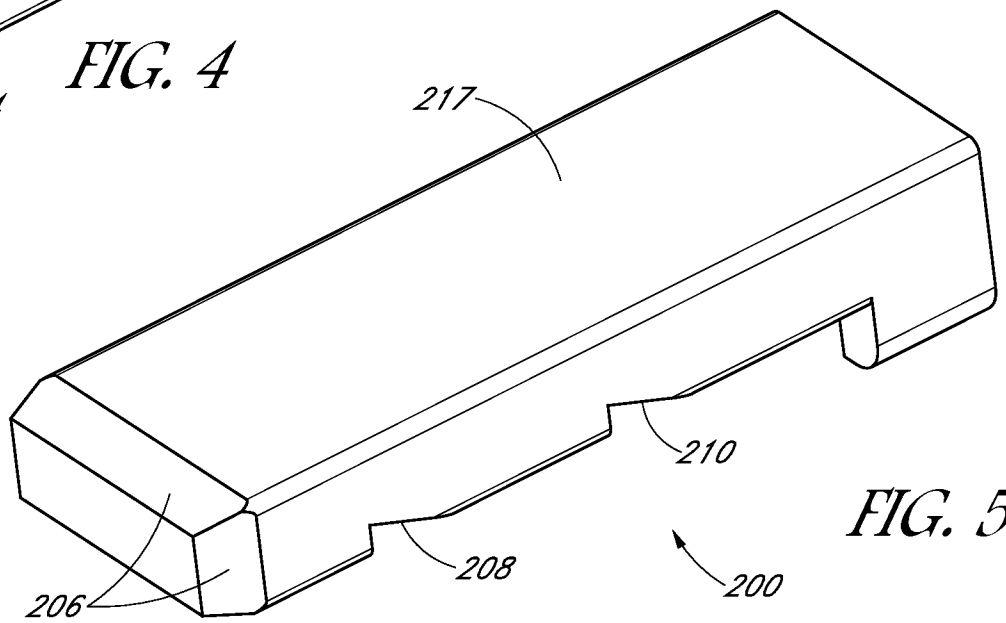
FIG. 5 shows a perspective view of the male connector from a bottom side.
Figure 7:
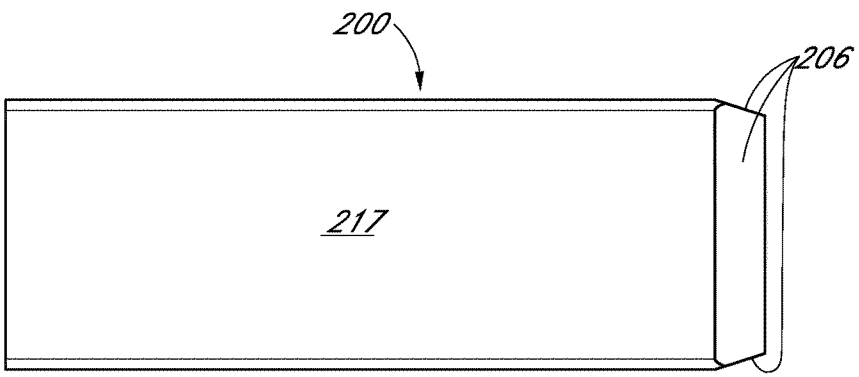
FIG. 7 shows a bottom plan view of the male connector.
Figure 6:
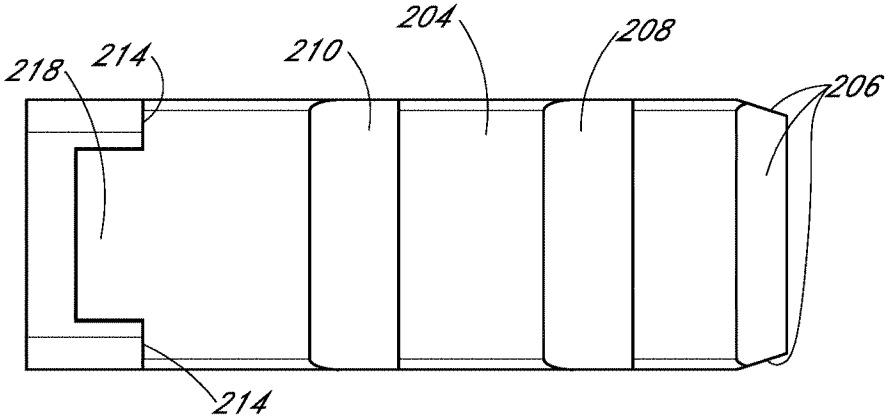
FIG. 6 shows a top plan view of the male connector.

As shown in FIG. 5, the bottom side of the male connector 200 is a planar surface 217. However, in some embodiments, the first locking groove 208 and the second locking groove 210 and the projection 216 may be on the bottom side of the body 204 of the male connector 200 instead of the top surface 212. In such a case, the corresponding features of the female connector 300 would likewise also be on its bottom side. In other embodiments, the male connector 200 may have one of the first locking groove 208, the second locking groove 210, and the transverse inner end wall 216 mirrored on the bottom side, in addition to being on the top surface 212.

Figure 11:
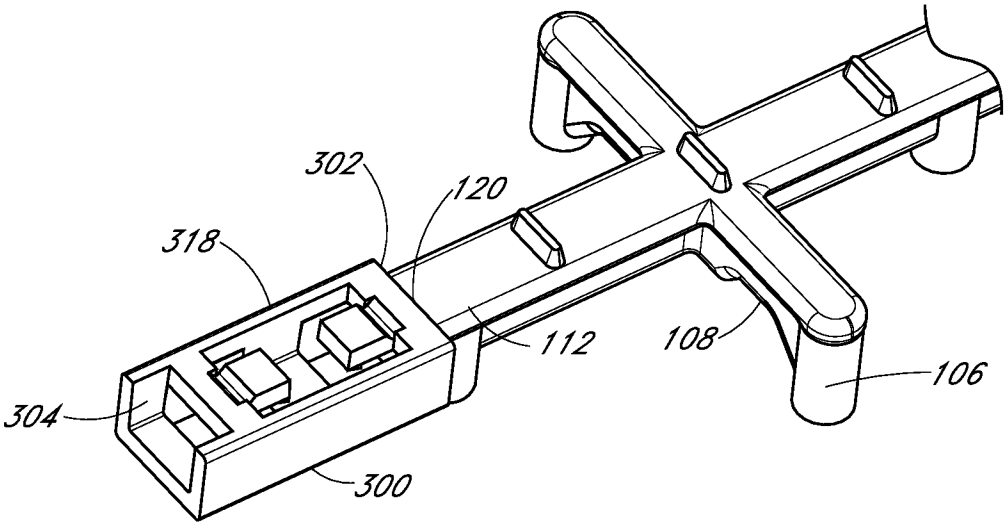
FIG. 11 shows a perspective view of the second end of the bolster element and the female connector from a top side.
Figure 12:
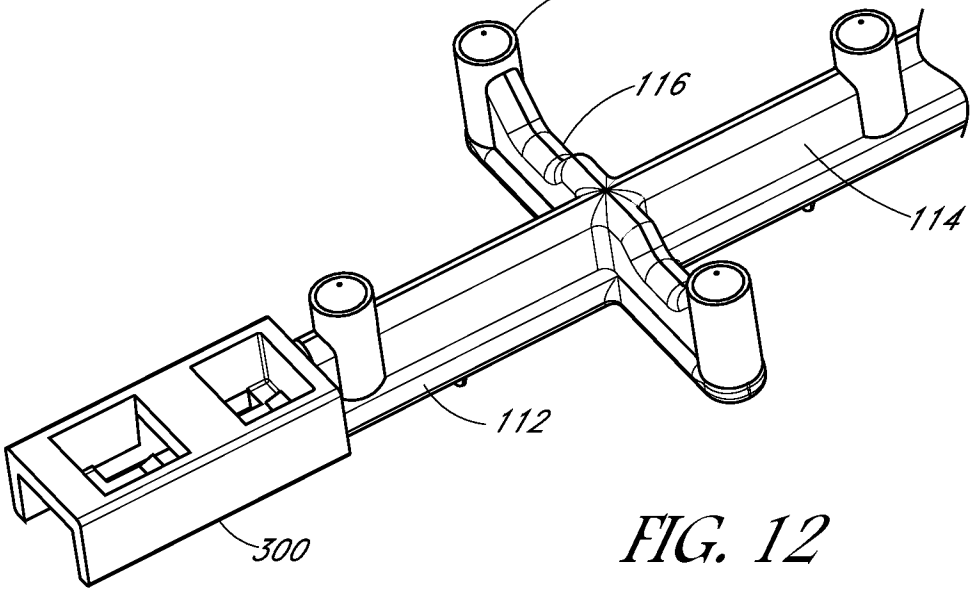
FIG. 12 shows a perspective view of the second end of the bolster element and the female connector from a bottom side.

FIGS. 11-14 illustrate the female connector 300. As shown in FIGS. 11 and 12, the female connector 300 has an inner end 302 at which it is attached to the second end 120 of the frame member 102. While the frame member 102 and the female connector 300 are preferably formed as an integral unit, they may be separately formed before being coupled together by means of plastic welding, welding, or adhesive.

The female connector 300 includes a receptacle body 318 The receptacle body 318 may be generally rectangular in cross-sectional shape, or any suitable alternative cross-sectional shape that is configured to receive the complementary insertion body 204 of the male connector 200. The receptacle body 318 defines a central opening 304 configured and dimensioned to conform to and receive the insertion body 204 of the male connector 200. For example, for the rectangular male connector 200 shown in the embodiment of FIGS. 4-10, the central opening 304 may be rectangular and be slightly larger than the male connector insertion body 204 to receive the male connector 200. In embodiments, the receptacle body 318 of the female connector 300 may have a width larger than the width of the top rail 112 of the frame member 102. In other embodiments, where the male connector insertion body 204 has a width smaller than the width of the top rail 112 of the frame member, the receptacle body 318 may have the same width or even a smaller width than the width of the top rail 112, while providing a central opening 304 for receiving the insertion body 204 of the male connector 200.

Figure 13:
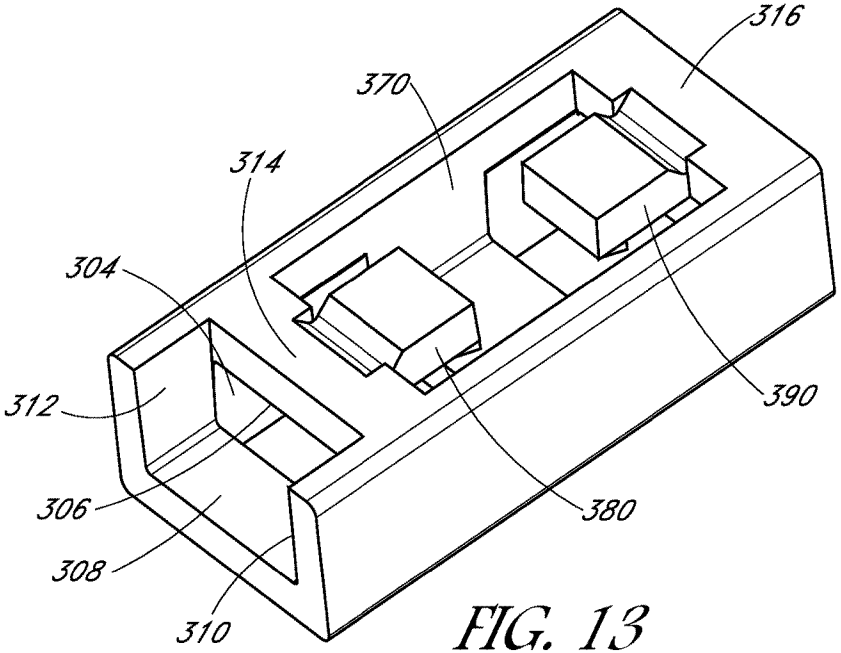
FIG. 13 shows a perspective view of the female connector from a top side.
Figure 15:
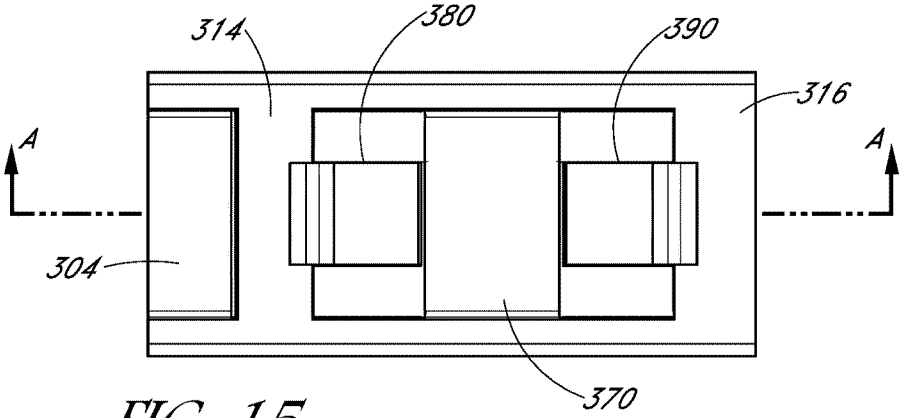
FIG. 15 shows a top plan view of the female connector.
Figure 18:
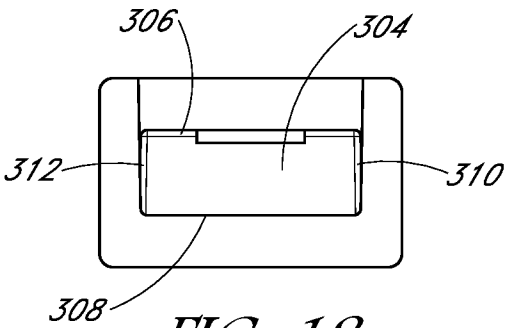
FIG. 18 shows a front plan view of the female connector.

As best shown in FIGS. 13 and 18, in embodiments of the female connector 300 having a generally rectangular receptacle body 318, the central opening 304 may be defined by a top wall 306, a bottom wall 308, and two side walls 310, 312. As shown in FIG. 13, the top of the female connector receptacle body 318 includes a top opening 370 bounded by the top wall 306, the two side walls 310, 312, and an end wall 316. The top opening 370 communicates with the interior of the receptacle body 318. Extending from the top wall 306 into the top opening 370 is a first locking tab 380. A second locking tab 390 may advantageously be provided, extending from the end wall 316 into the top opening 370 opposite the first locking tab 380. That is, the first locking tab 280 and the second locking tab 290 may extend towards each other. The first locking tab 380 and the second locking tab 390 can be cantilevered from the top wall 306 and the end wall 316, respectively.

Figure 14:
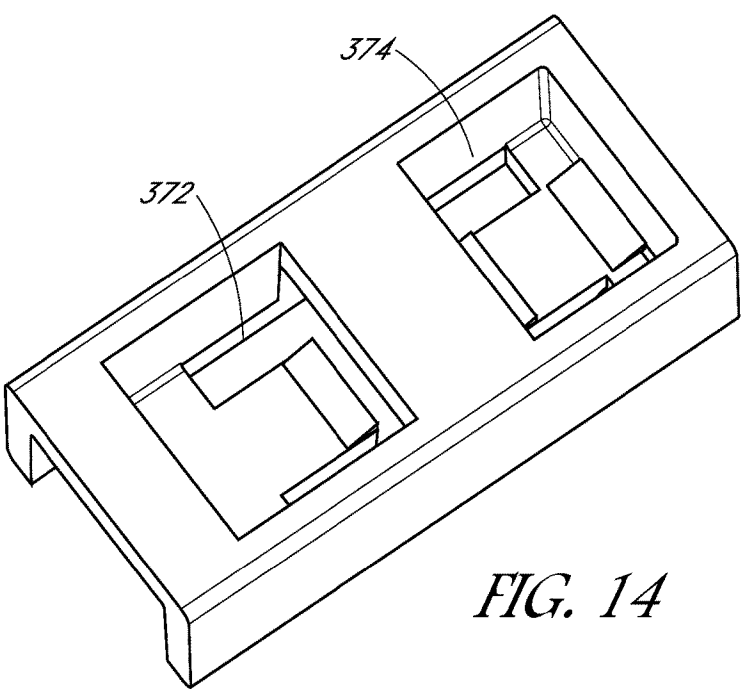
FIG. 14 shows a perspective view of the female connector from a bottom side.
Figure 16:
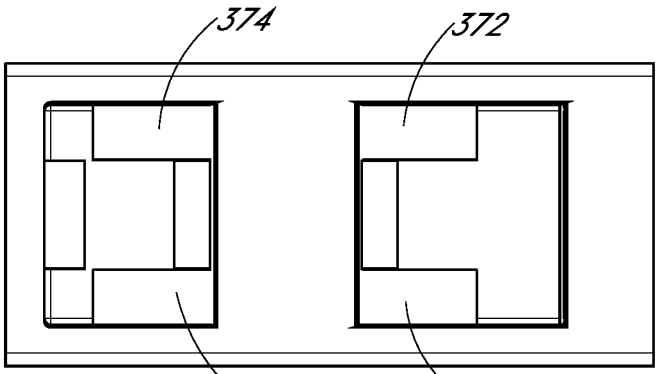
FIG. 16 shows a bottom plan view of the female connector.
Figure 19:
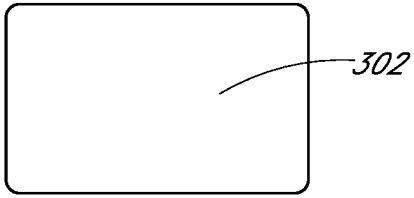
FIG. 19 shows a back plan view of the female connector.

As shown, for example, in FIGS. 14 and 16, the bottom of the receptacle body 318 of the female connector 300 may advantageously (but not necessarily) have a bottom opening corresponding to each of the locking tabs 380, 390. The exemplary illustrated embodiment has a first bottom opening 372 and a second bottom opening 374, positionally aligned with the first locking tab 380 and the second locking tab 390, respectively. It is understood that only one bottom opening may be provided in embodiments having only one locking tab.

Figure 17:
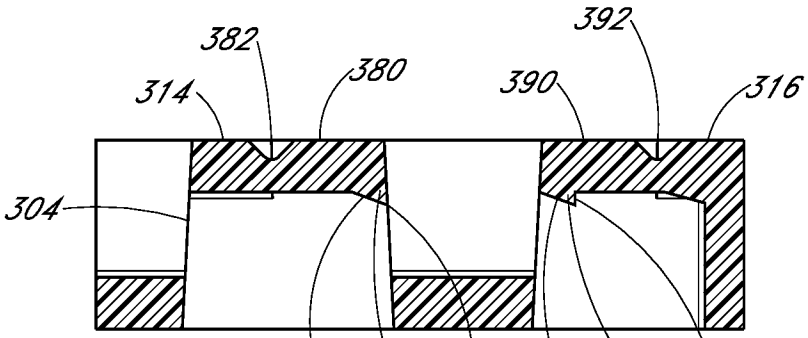
FIG. 17 shows a cross-sectional view of the female connector, taken along line A-A of FIG. 15.

As shown in cross-section in FIG. 17, the first locking tab 380 can be attached to the top wall 306 by a first living hinge 382, and the second locking tab 390 (if present) can be attached to the end wall 316 by a second living hinge 392. The living hinges 382, 392 are provided by thinner sections of material, allowing the tabs 380, 390 to be resiliently flexible, thereby allowing for deflection or movement of the first locking tab 380 and the second locking tab 390 relative to the top wall 306 and the end wall 316, respectively. The first locking tab 380 and the second locking tab 390 engage the insertion body 204 of the male connector 200 when the insertion body 204 is inserted into the receptacle body 318 of the female connector 300 through the central opening 304, as described below. The resilient deflection of the first locking tab 380 and the second locking tab 390 as a result of such engagement provides a sufficiently secure connection between the male and female connectors to substantially reduce the likelihood of accidental disassembly due to outside forces pressing on the locking tabs, thereby providing a bolster assembly that is durable and unlikely to come apart accidentally. Alternatively, in some embodiments, the first locking tab 380 and the second locking tab 390 may be deemed "resiliently flexible" without a living hinge or the equivalent when the receptacle body 318 itself has sufficient flexibility to yield to allow for insertion of the insertion body 204 of the male connector 200.

Additionally, each of the locking tabs 380, 390 provides a secure definitive catch or lock between the male connector 200 and the female connector 300; this effect is, of course, enhanced by the use of two locking tabs in tandem, as in the illustrated embodiment. Also, as discussed in more detail below, the double catch or double lock connection between the insertion body 204 of the male connector 200 and the receptacle body 318 of the female connector 300 facilitates the connection of bolster elements with a relatively low connection force.

The above objectives are further enhanced in embodiments in which the first locking tab 380 includes a first detent 384, and the second locking tab 390 includes a second detent 394, as shown in FIG. 17. The first detent 384 and the second detent 394 project into the interior of the receptacle body 318 and are configured for engaging with the second locking groove 210 and the first locking groove 208, respectively, of the insertion body 204 of the male connector 200. Each of the first and second detents 384, 394 may, in some embodiments, advantageously have an engagement surface 386, 396, and an angled or sloped wedge surface 388, 398. When the locking tabs 380, 390 are in their relaxed (unflexed or undeflected) states, the detents 384, 394 can thus positively engage the insertion body 204 of the male connector 200 as it is inserted into receptacle body 318 through the central opening 304. Due to the cantilevered connection of the first locking tab 380 and the second locking tab 390 to the top wall 306 and the end wall 316, respectively, by the living hinges 382, 392, the first locking tab 380 and the second locking tab 390 are resiliently deflected to allow the insertion body 204 of the male connector to be fully inserted into the receptacle body 318 of the female connector 300.

More specifically, as the insertion body 204 is inserted into the receptacle body 318, the upper (as shown in the drawings) surface 212 of the insertion body 204 engages the detents 384, 394 to flex or deflect the locking tabs 380, 390 upwardly to allow clearance of the insertion body 204. When the first detent 384 encounters the first locking groove 208, the resiliency of the first tab 380 snaps the first detent 384 into the first locking groove 208. Further insertion of the insertion body 204 into the receptacle body 318 brings the first detent 384 into engagement with the sloped surface 208*a* of the first locking groove 208, which acts as a wedge or ramp to resiliently guide the first tab 380 upwardly until the first detent 384 again encounters the flat upper surface 212 of the insertion body 204. Further insertion of the insertion body 204 brings the first detent 384 into the second locking groove 210, and in a similar fashion, brings the second detent 394 into engagement with the first locking groove 208. With the first and second detents 384, 394 respectively seated in the second and first locking grooves 210, 208, the tabs 380, 390 resiliently return to their relaxed (unflexed) positions to lock the insertion body 204 in place within the receptacle body 318.

Figure 20:
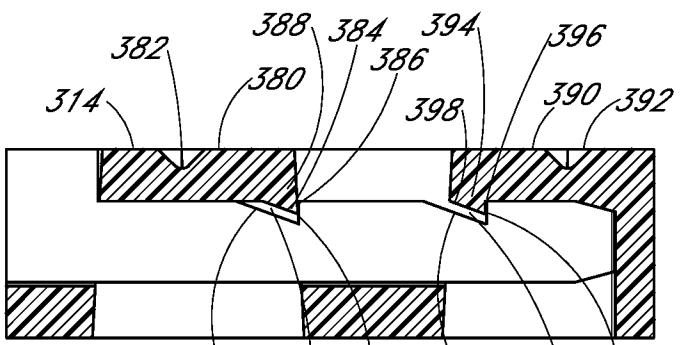
FIG. 20 shows a cross-section view of the male and female connectors in a coupled configuration.

In operation, as shown in FIG. 20, when a male connector 200 of one frame element is inserted into the female connector 300 of another frame element, the angled surfaces 388, 398 of the detents 384, 394 allow for the first locking groove 208 to engage sequentially with the first detent 384 of the first tab 380 and then with the second detent 394 of the second tab 390, at which point the first detent 384 is seated in the second locking groove 210 and the second detent 394 is seated in the first locking groove 208 of the male connector insertion body 204. Thus, the sloped surface 208*a* of the first locking groove 208 deflects the first locking tab 380, allowing the insertion body 204 to slide past the first 384 detent of the first locking tab 380. Upon full insertion of the male connector 200 into the female connector 300, the catch surfaces 208*b*, 210*b* of the first locking groove 208 and the second locking groove 210 can be moved past the engagement surfaces 386, 396 of the first locking tab 380 and the second locking tab 390, respectively. The restorative force of the previously deflected first locking tab 380 and the second locking tab 390 can thereby position the detents 384, 394 respectively into the second locking groove 210 and the first locking groove 208. The relatively vertical locking surfaces 386, 396 can then prevent inadvertent separation of the male connector 200 and the female connector 300 by catching on the catch surfaces 210*b*, 208*b* of the second locking groove 210 and the first locking groove 208. The corresponding shapes of the male connector 200 and the central opening 304 of the female connector provide for secure connection under tensile loads and flexural loads. Further contributing to the strength and durability of the connection is the substantially solid nature of the insertion body 204 of the male connector 200, which allows it to withstand distortional forces that could result in a loosening of the connection, or possible decoupling of the male and female connectors.

As will be appreciated, a slab bolster assembly in accordance with this disclosure may comprise at least first and second slab bolster elements, each of which comprises a frame member having a male connector at a first end and a complementary female connector at a second end, wherein the female connector of the first slab bolster element is configured to interconnect with the male connector of the second slab bolster element when the male connector of the second slab bolster element is inserted into the female connector of the first slab bolster element, and wherein the male and female connectors are constructed as described above and as illustrated in the drawings.

Although embodiments of a slab bolster element, its components, and related methods have been specifically described and illustrated herein, many modifications and variations will be apparent to those skilled in the art. Furthermore, it is understood and contemplated that features specifically discussed for a lab bolster element in accordance with any one embodiment of this disclosure may be adopted for inclusion with another such slab bolster embodiment, provided the functions are compatible. Accordingly, it is to be understood that the disclosed slab bolster element embodiments, their components, and related methods according to this disclosure may be embodied other than as specifically described herein.

What is claimed is:

1. A slab bolster assembly comprising a plurality of slab bolster elements, each of the slab bolster elements comprising:

a frame member having a male connector at a first end and a female connector at an opposite second end;

the male connector including an insertion body with a surface having first and second transverse locking grooves;

the female connector including a receptacle body configured to receive the insertion body of a complementary male connector, the receptacle body including first and second resiliently flexible locking tabs positioned and configured to deflect resiliently as the insertion body is inserted into the receptacle body, wherein the first locking tab is positioned to engage the second locking groove of the insertion body, and the second locking tab is positioned to engage the first transverse locking groove of the insertion body when the insertion body is received within the receptacle body; and wherein the first resiliently flexible locking tab and the second resiliently flexible locking tab are cantilevered and extend towards each other.

2. The slab bolster assembly of claim 1, wherein each of the first and second resiliently flexible locking tabs is attached to the receptacle body by a living hinge.

3. The slab bolster assembly of claim 1, wherein the first resiliently flexible locking tab includes a detent comprising an engagement surface and an angled or sloped wedge surface.

4. The slab bolster assembly of claim 1, wherein the first locking groove is perpendicular relative to a length of the frame member.

5. A slab bolster element, comprising:

a frame having a first end and an opposed second end;

a male connector at the first end, the male connector comprising an insertion body including a first transverse locking groove and a second transverse locking groove in a surface of the insertion body; and a female connector at the second end, the female connector comprising a receptacle body configured for receiving the insertion body of a male connector of another slab bolster element, wherein the receptacle body includes a first resiliently deflectable locking tab and a second resiliently deflectable locking tab, wherein the first resiliently flexible locking tab and the second resiliently flexible locking tab are cantilevered and extend toward each other;

wherein, when the insertion body of the male connector of the other slab bolster element is inserted into the receptacle body, the first resiliently deflectable locking tab is positioned to engage with the second locking groove of the insertion body of the male connector of the other slab bolster, and the second resiliently deflectable locking tab is positioned to engage with the first locking groove of the insertion body of the male connector of the other slab bolster element.

6. The slab bolster element of claim 5, wherein each of the first resiliently flexible locking tab and the second resiliently flexible locking tab is attached to the receptacle body by a living hinge.

7. The slab bolster element of claim 5, wherein the first transverse locking groove comprises a sloped surface and a substantially vertical catch surface.

8. The slab bolster element of claim 5, wherein a distal end of the insertion body of the male connector has at least one chamfered edge configured to facilitate insertion of the insertion body into the receptacle body.

9. The slab bolster element of claim 5, wherein a distal end of the insertion body of the male connector has at least one chamfered edge configured to facilitate insertion of the insertion body into the receptacle body.

10. A method of assembling first and second slab bolster elements, comprising:

providing a first slab bolster element having a first frame member with a male connector at one end, wherein the male connector includes a substantially solid insertion body having first and second transverse locking grooves in a surface thereof, wherein an entirety of the substantially solid insertion body is non-deformable;

providing a second slab bolster element having a second frame member with a female connector at one end, wherein the female connector includes a receptacle body configured to receive the insertion body of the male connector and having first and second resiliently flexible locking tabs, wherein the first resiliently flexible locking tab and the second resiliently flexible locking tab are cantilevered and extend towards each other; and inserting the insertion body of the male connector of the first slab bolster element into the receptacle body of the female connector of the second slab bolster element until the second resiliently flexible locking tab resiliently engages the first transverse locking groove and the first resiliently flexible locking tab resiliently engages the second transverse locking groove, thereby to lockingly couple the male connector and the female connector.

11. The method of claim 10, wherein each of the first and second reliantly flexible locking tabs is attached to the receptacle body of the female connector by a living hinge.

* * * * *